US006739002B1

(12) United States Patent
Pannu

(10) Patent No.: US 6,739,002 B1
(45) Date of Patent: May 25, 2004

(54) BED SHEET FASTENER SYSTEM

(76) Inventor: Jaswant Singh Pannu, 2219 NE. 15th Ter., Wilton Manors, FL (US) 33305

( * ) Notice: Subject to any disclaimer, the term of this patent is extended or adjusted under 35 U.S.C. 154(b) by 0 days.

(21) Appl. No.: 10/408,645

(22) Filed: Apr. 7, 2003

(51) Int. Cl.[7] ..... A47G 9/04
(52) U.S. Cl. ..... 5/494; 5/496; 5/498; 5/923
(58) Field of Search ..... 5/923, 484, 494, 5/496, 498, 499, 501; 108/90

(56) References Cited

U.S. PATENT DOCUMENTS

| | | | | | |
|---|---|---|---|---|---|
| 2,630,587 | A | | 3/1953 | Brown | |
| 3,066,321 | A | * | 12/1962 | Kintner | 5/498 |
| 3,066,323 | A | * | 12/1962 | Kintner | 5/496 |
| 3,530,487 | A | | 9/1970 | Beer | |
| 4,057,862 | A | | 11/1977 | LaBianco | |
| 4,301,561 | A | | 11/1981 | McLeod | |
| 4,488,323 | A | * | 12/1984 | Colburn | 5/692 |
| 4,646,375 | A | | 3/1987 | Parker | |
| 4,899,408 | A | | 2/1990 | Illingworth | |
| 4,979,251 | A | | 12/1990 | Lazar | |
| 5,086,530 | A | | 2/1992 | Blake | |
| 5,205,003 | A | | 4/1993 | Green | |
| 5,208,926 | A | | 5/1993 | Stackhouse | |
| 5,335,383 | A | | 8/1994 | Schwind | |
| 5,367,729 | A | * | 11/1994 | Lazar et al. | 5/494 |
| 5,572,754 | A | * | 11/1996 | Lazar et al. | 5/494 |
| 5,666,680 | A | | 9/1997 | Hackett, Jr. | |
| 5,733,397 | A | | 3/1998 | McDaniel | |
| 5,794,285 | A | | 8/1998 | Burch | |
| 6,009,579 | A | * | 1/2000 | Pedersen | 5/690 |
| 6,088,859 | A | | 7/2000 | Cavazos | |
| 6,243,895 | B1 | * | 6/2001 | Amin | 5/498 |

* cited by examiner

*Primary Examiner*—Michael F. Trettel
(74) *Attorney, Agent, or Firm*—Christopher & Weisberg, P.A.

(57) ABSTRACT

A bedding system is provided which includes a mattress and a sheet, wherein the sheet is adjustably securable to the mattress using opposing hook and pile fastener strips. A continuous hook and pile fastener strip is affixed to the peripheral edge of the mattress and is engaged by sets of opposing hook and pile fastener strips affixed to the bed sheet. The hook and pile fastener strips releasably secure the bed sheet to the mattress.

13 Claims, 4 Drawing Sheets

BED SHEET FASTENER SYSTEM

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates to bedding and more particularly to a system and method for securing a bed sheet to a mattress.

BACKGROUND OF THE INVENTION

Conventional bed sheets are typically rectangular in shape and are secured to the mattress by tucking the edges of the bed sheet between the mattress and the box spring. Conventional sheets are prone to bunching-up, or even being pulled out, or untucked, during use. For example, active or restless sleepers who toss and turn or even thrash about in their sleep can easily untuck the sheet. Additionally, some people are sensitive to small wrinkles when sleeping. As such, the bed must sometimes be entirely remade after each use.

So-called fitted sheets have come into widespread use, wherein the corners of the fitted sheets include elastic members that are positionable about the corners of the mattress to secure the fitted sheet to the mattress. However, the edges of the fitted sheet remain loose, enabling the sheet to bunch up during use. Accordingly, it would be desirable to have a securable bed sheet, which would resist bunching, remaining flat on the mattress.

SUMMARY OF THE INVENTION

The present invention provides a bedding system including a mattress and a sheet, wherein the sheet is adjustably securable to the mattress using opposing hook and pile fastener strips. The bedding system includes a mattress having a top surface, a pair of opposing side panels, a foot panel, and a head panel. At least one hook and pile fastener strip is attached to the mattress continuously about a peripheral edge the opposing side panels, foot panel, and head panel. The bedding system further includes a bed sheet having hook and pile fastener strips positioned about an outer edge portion of the sheet, wherein the bed sheet hook and pile fastener strips are substantially perpendicular to the mattress hook and pile fastener strip. The bed sheet is positionable about the mattress such that the hook and pile fastener strips on the bed sheet releasably engage the hook and pile fastener strip on the mattress, securing the bed sheet to the mattress.

The bed sheet is secured to the mattress by aligning the opposing side edges, foot edge, and head edge of the bed sheet with opposing side panels, foot panel, and head panel of the mattress. The bed sheet is positioned on the mattress, with the pairs of hook and pile fastener strips on the bed sheet being drawn over and engaging the hook and pile fastener strips on the mattress. The bed sheet is drawn tight over the mattress by systematically detaching each of the pair of sheet hook and pile fastener strips on the bed sheet from the mattress, and pulling the bed sheet tight over the mattress. The bed sheet hook and pile fastener strips are re-affixed to the hook and pile fastener strips on the mattress, securing the bed sheet to the mattress. This is process is repeated for each of the hook and pile fastener strips on the bed sheet until there is no bunching, or visible creases in the bed sheet. This process can be repeated as desired.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
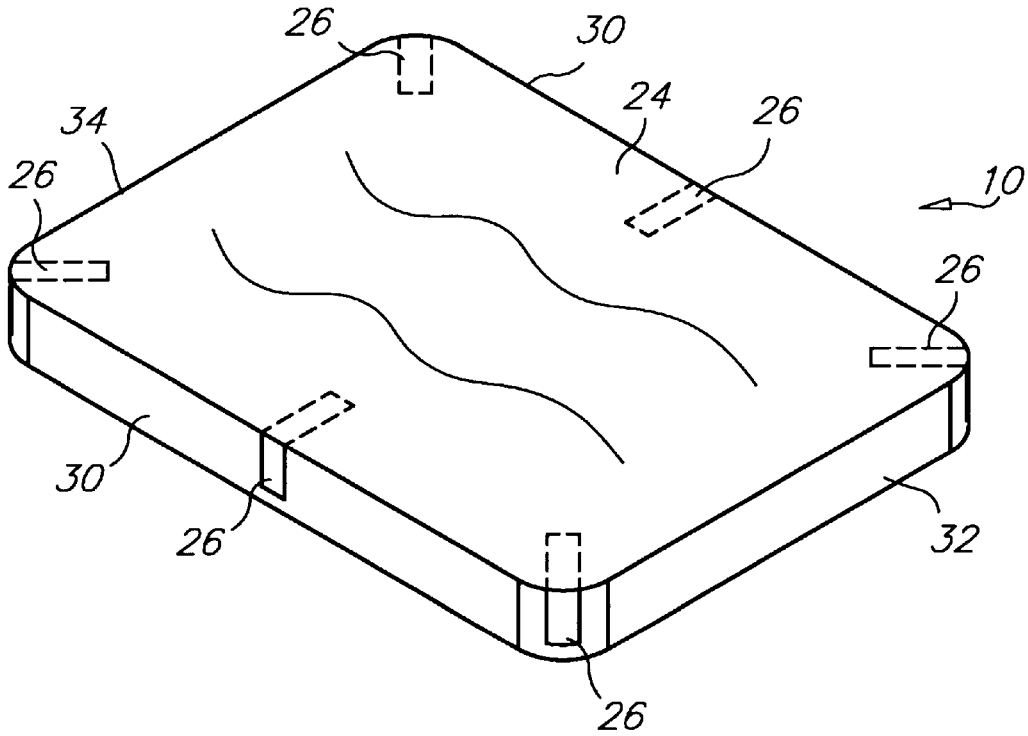
FIG. 1 is a side perspective exploded view of the bedding system of the present invention.
Figure 1:
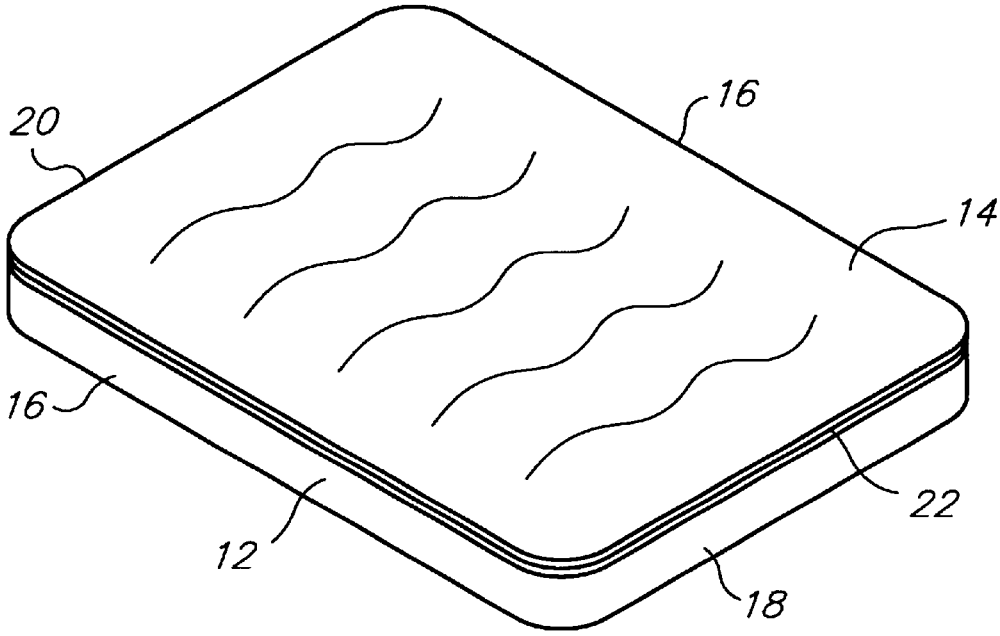

The present invention provides a bedding system including a mattress and a sheet, wherein the sheet is adjustably securable to the mattress using opposing hook and pile fastener strips. Referring to FIG. 1, the bedding system 10 includes a mattress 12 having a top surface 14, a pair of opposing side panels 16, a foot panel 18, and a head panel 20. At least one hook and pile fastener strip 22 is attached to the mattress 12, continuously about a peripheral edge the opposing side panels 16, foot panel 18, and head panel 20. The bedding system 10 further includes a bed sheet 24 having a plurality of hook and pile fastener strips 26 positioned about an outer edge portion of the sheet 24, wherein the hook and pile fastener strips 26 on the bed sheet 24 are substantially perpendicular to the hook and pile fastener strip 22 on the mattress 12. The bed sheet 24 is positionable about the mattress 12 such that the hook and pile fastener strips 26 on the bed sheet 24 engage the hook and pile fastener strip 22 on the mattress 12, securing the bed sheet 24 to the mattress 12.

Figure 2:
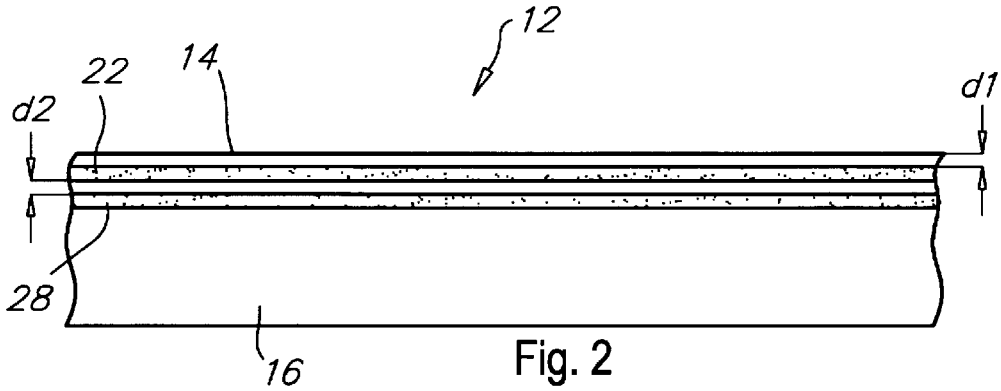
FIG. 2 is a partial side view of the mattress of the bedding system of the present invention.

Referring to FIGS. 1 and 2, a first hook and pile fastener strip 22 is affixed to the mattress 12, longitudinally circumferencing the opposing side panels 16, foot panel 18, and head panel 20. The first hook and pile fastener strip 22 is affixed to the mattress 12 a distance "d1" from the top surface 14 of the mattress 12. The distance "d1" is, for example, between about 0 inches to 4 inches. A second hook and pile fastener strip 28 is optionally affixed to the mattress 12, longitudinally circumferencing the opposing side panels 16, foot panel 18, and head panel 20. The second hook and pile fastener strip 28 is affixed to the mattress 12 a distance "d2" from the first hook and pile fastener strip 22. The distance "d2" is, for example, between about 0.5 inches to 2 inches. The mattress hook and pile fastener strip 22 uninterruptly circumferences the mattress 12 and is between about 1 inch to 4 inches in width.

The hook and pile fastener strips 22 and 28 are affixed to the mattress 12 by means known in the art, including, but not limited to, sewing and gluing.

Figure 3:
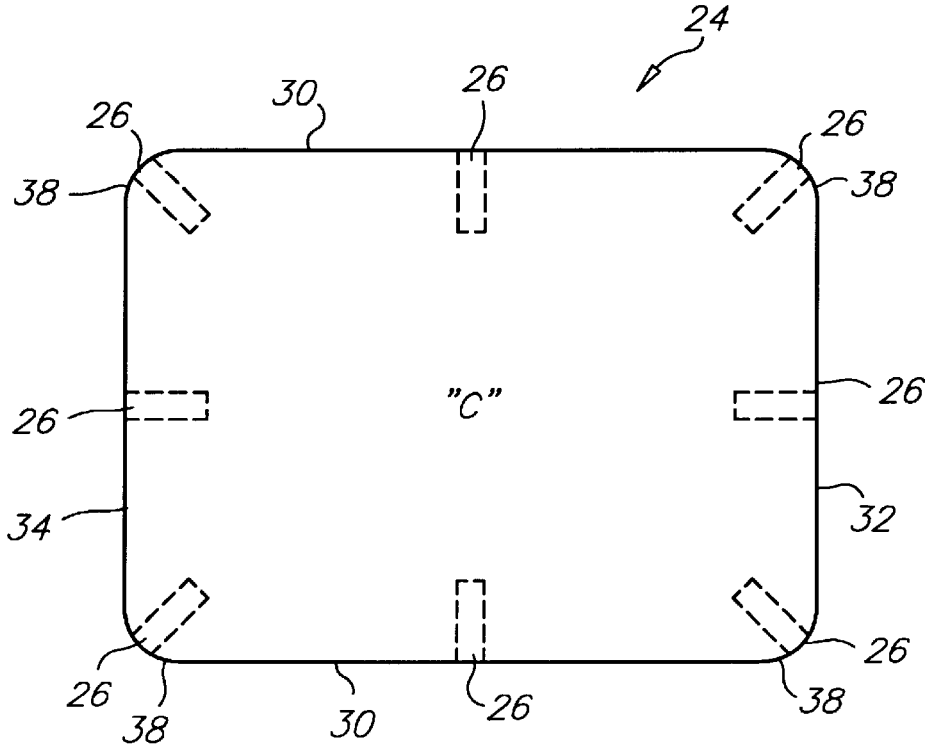
FIG. 3 is a top view of the bed sheet of the bedding system of the present invention.
Figure 4:
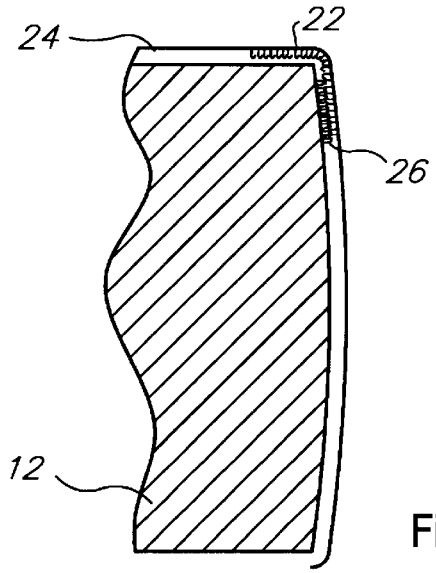
FIG. 4 is a cutaway side view showing the bed sheet engaging the mattress.

Referring to FIGS. 1 and 3, the bed sheet 24 includes opposing side edges 30, a foot edge 32, and a head edge 34. The bed sheet 24 includes at least one hook and pile fastener strip 26 affixed to the each of the opposing side edges 30 of bed sheet 24, where, for example, the at least one hook and pile fastener strips 26 are substantially, mirrorly positioned on the opposing side edges 30. Additionally, at least one hook and pile fastener strip 26 is also affixed to each of the four corners 38 of the bed sheet 24, wherein the corner hook and pile fastener strips 26 are directed substantially towards the center "C" of the bed sheet 24. The bed sheet hook and pile fastener strips 26 are affixed to the bed sheet 24 such that the bed sheet hook and pile fastener strips 26 are generally perpendicular to the mattress hook and pile fastener strip 22, wherein the bed sheet hook and pile fastener strips 26 are between about 4 inched to 12 inches in length and between about 0.5 inch to 2 inches in width. Referring to FIG. 4, the bed sheet is exemplary shown as a fitted bed sheet, and can additionally be a conventional, or flat, bed sheet.

In an exemplary embodiment, at least one hook and pile fastener strip 26 is affixed to the foot edge 32 and the head edge 34, where, for example, the hook and pile fastener strips 26 are substantially mirrorly position on the foot edge 32 and the head edge 34. The foot edge 32 and the head edge 34 include identifying markers to properly aligning the bed sheet 24 on the mattress 12.

In an exemplary embodiment, a pair of hook and look fastener strips 26 are affixed to each of the opposing side edges 30, the foot edge 32, and the head edge 34. The hook and pile fastener strips are evenly position along the lengths of the opposing side edges 30, the foot edge 32, and the head edge 34. Additionally, three hook and pile fastener strips 26 are evenly position about each of the four corners 38 of the best sheet 24.

The bed sheet hook and pile fastener strips 26 are affixed to the bed sheet 24 by means known in the art, including, but not limited to, sewing and gluing.

Referring to FIGS. 1 and 4, the bed sheet 24 is secured to the mattress 12 by aligning the opposing side edges 30, foot edge 32, and head edge 34 of the bed sheet 24 with opposing side panels 16, foot panel 18, and head panel 20 of the mattress 12. The bed sheet 24 is positioned on the mattress 12, with the hook and pile fastener strips 26 on the bed sheet 24 being drawn over and engaging the hook and pile fastener strips 22 on the mattress 12. The bed sheet 24 is drawn tight over the mattress 12 by systematically detaching each of the pair of sheet hook and pile fastener strips 26 on the bed sheet 24 from the mattress 12, and pulling the bed sheet 24 tight over the mattress 12. The bed sheet hook and pile fastener strips 26 are re-affixed to the hook and pile fastener strips 22 on the mattress 12, securing the bed sheet 24 to the mattress 12. This process is repeated for each of the hook and pile fastener strips 26 on the bed sheet 24 until there is no bunching, or visible creases in the bed sheet 24. Additionally, this process can be repeated, as desired, after each use of the mattress 12 and bed sheet 24 to remove any resulting visible creases in the bed sheet 24.

Figure 5:
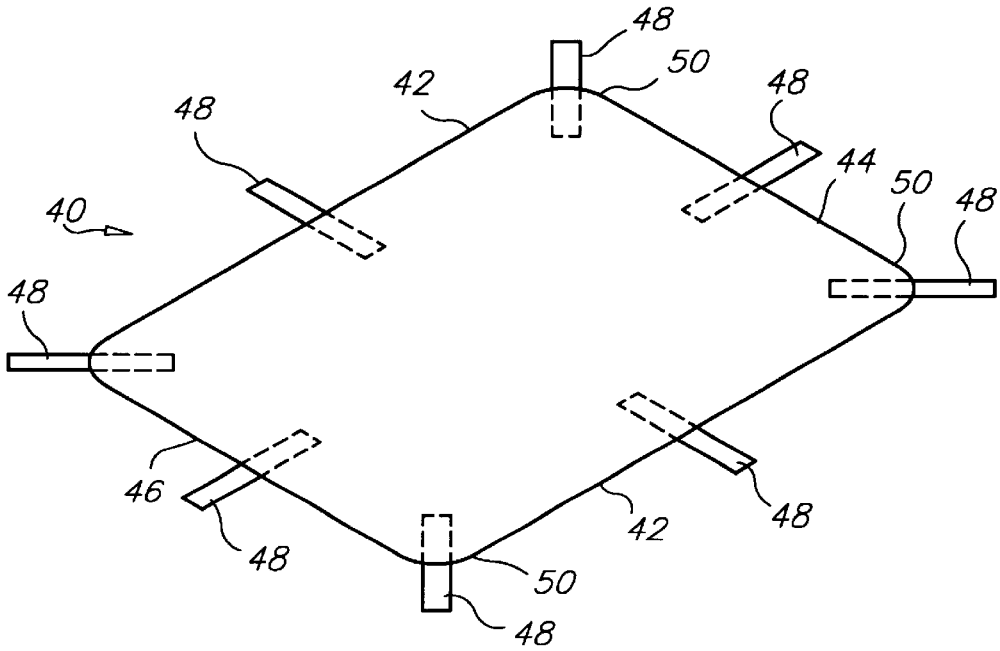
FIG. 5 is a top view of a mattress pad in accordance with the invention.

Referring to FIG. 5, the bedding system of the present invention can further include a mattress pad 40, including opposing side edges 42, a foot edge 44, and a head edge 46. The mattress pad 40 includes at least one hook and pile fastener strip 48 affixed to each of the opposing side edges 42, wherein the at least one hook and pile fastener strips 48 are mirrorly positioned on the opposing side edges 42. At least one hook and pile fastener strip 48 is affixed to each of the four corners 50 of the mattress pad 40. The hook and pile fastener strips 48 are positioned so as not to be interposed between the bed sheet pairs of hook and pile fastener strips 26 and the mattress hook and pile fastener strips 22. The mattress pad hook and pile fastener strips 48 are affixed to the mattress pad such that the mattress pad hook and pile fastener strips 48 are substantially perpendicular to the mattress hook and pile fastener strip 22. The mattress pad hook and pile fastener strips 48 are, for example, between about 4 inched to 12 inches in length and between about 0.5 inches to 2 inches in width.

In an exemplary embodiment, at least one hook and pile fastener strip 48 is affixed to the foot edge 44 and the head edge 46 of the mattress pad 40, where, for example, the hook and pile fastener strips 48 are substantially mirrorly positioned on the foot edge 44 and head edge 46 of the mattress pad 40. The hook and pile fastener strips 48 are position so as not to be interposed between the bed sheet pairs of hook and pile fastener strips 26 and the mattress hook and pile fastener strip 22. The mattress pad hook and pile fastener strips 48 are, for example, between about 2 inched to 12 inches in length and between about 0.5 inches to 4 inches in width.

The mattress pad hook and pile fastener strips 48 are affixed to the mattress pad 40 by means know in the art, including, but not limited to, sewing and gluing.

In a method of use, the mattress pad 40 is secured to the mattress 12 by aligning the opposing side edges 42, foot edge 44, and head edge 46 of the mattress pad 40 with opposing side panels 16, foot panel 18, and head panel 20 of the mattress 12. The mattress pad 40 is positioned on the mattress 12, with the mattress pad hook and pile fastener strips 48 being drawn over and engaging the hook and pile fastener strip 22 on the mattress 12. The mattress pad 40 is drawn tight over the mattress 12 by systematically detaching each of the mattress pad hook and pile fastener strips 48 from the mattress 12, and pulling the mattress pad 40 tight over the mattress 12. The mattress pad hook and pile fastener strips 48 are re-affixed to the hook and pile fastener strip 22 on the mattress 12, securing the mattress pad 40 to the mattress 12. This process is repeated for each of the pair of hook and pile fastener strips 26 on the mattress pad 40 until there are no bunching, or visible creases in the mattress pad 40.

The bed sheet 24 is secured to the mattress 12, over the mattress pad 40, by aligning the opposing side edges 30, foot edge 32, and head edge 36 of the bed sheet 24 with opposing side panels 16, foot panel 18, and head panel 20 of the mattress 12. The bed sheet 24 is positioned on the mattress 12, over the mattress pad 40, with the hook and pile fastener strips 26 being drawn over and engaging the hook and pile fastener strips 22 on the mattress 12, wherein the mattress pad hook and pile fastener strips 48 do not interfere with the bed sheet hook and pile fastener engagement with the mattress hook and pile strip 22. The bed sheet 24 is drawn tight over the mattress 12 and mattress pad 40 by systematically detaching each of the pair of sheet hook and pile fastener strips 26 on the bed sheet 24 from the mattress 12, and pulling the bed sheet 24 tight over the mattress 12 and mattress pad 40. The bed sheet pairs hook and pile fastener strips 26 are re-affixed to the hook and pile fastener strip 22 on the mattress 12, securing the bed sheet 24 to the mattress 12. This process is repeated for each of the pair of hook and pile fastener strips 26 on the bed sheet 24 until there is no bunching, or visible creases in the bed sheet 24. Additionally, this process can be repeated, as needed, after use of the mattress 12 and bed sheet 24 to remove visible creases in the bed sheet 24.

Figure 6:
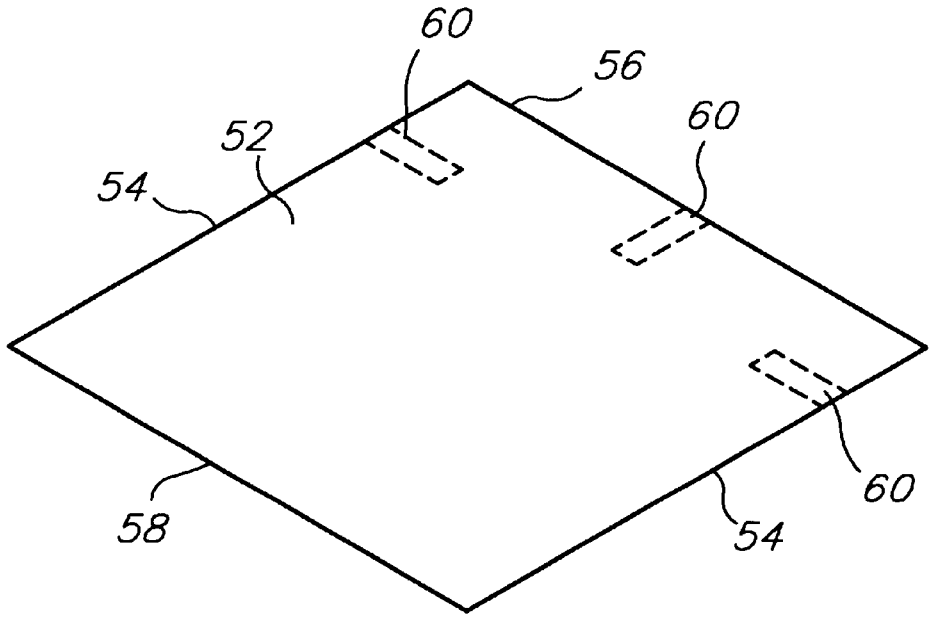
FIG. 6 is a side perspective exploded view of a cover sheet and bed sheet of the present invention.
Figure 6:
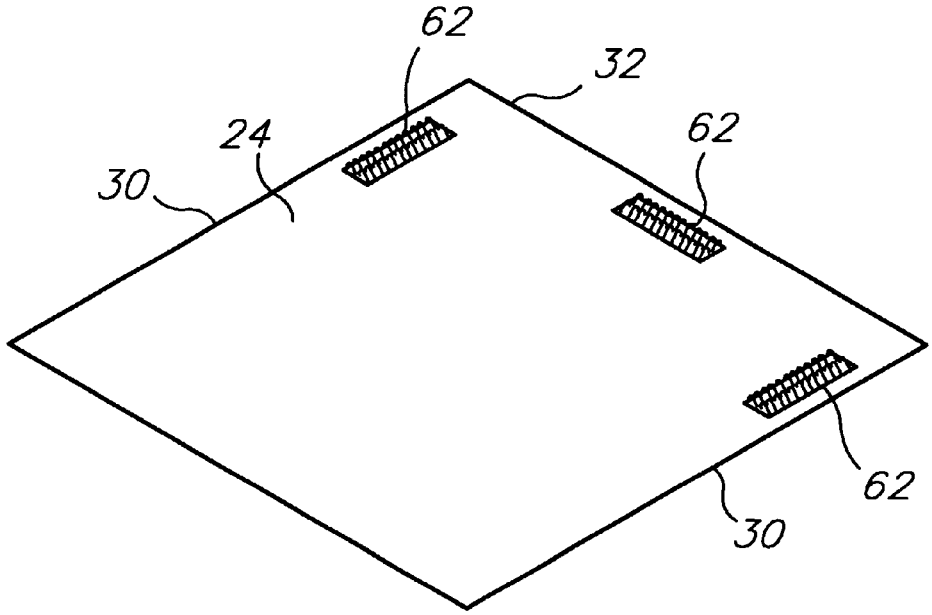

Referring to FIG. 6, the bedding system of the present invention can further include a cover sheet 52, including opposing side edges 54, a foot edge 56, and a head edge 58. The cover sheet 52 includes at least one hook and pile fastener strip 60 affixed to the foot edge 56. The hook and pile fastener strip 60 is positioned on the foot edge 56 so as to engage a matching hook and pile fastener strip 62 affixed to the upper surface of the fort edge 32 of the bed sheet 24. The cover sheet hook and pile fastener strip 60 is affixed to the cover sheet 52 such that the cover sheet hook and pile fastener strip 60 is substantially perpendicular to the bed sheet hook and pile fastener strip 62.

In a further exemplary embodiment, cover sheet hook and pile fastener strips 60 are affixed to the opposing side edges 54 adjacent to the foot edge 56 of the cover sheet 52. The hook and pile fastener strips 60 are positioned on the opposing side edges 54 so as to engage matching hook and pile fastener strips 62 affixed to the upper surface of the opposing side edges 30 of the bed sheet 24.

The cover sheet hook and pile fastener strips 60 are affixed to the cover sheet by means know in the art, including, but not limited to, sewing and gluing.

In a method of use, the bed sheet 24 is secured to the mattress 12 by aligning the opposing side edges 30, foot edge 32, and head edge 36 of the bed sheet 24 with opposing side panels 16, foot panel 18, and head panel 20 of the mattress 12. The bed sheet 24 is positioned on the mattress 12, with the pairs of hook and pile fastener strips 26 being drawn over and engaging the hook and pile fastener strip 22 on the mattress 12. The bed sheet 24 is drawn tight over the mattress 12 by systematically detaching each of the pair of sheet hook and pile fastener strips 26 on the bed sheet 24 from the mattress 12, and pulling the bed sheet 24 tight over the mattress 12. The bed sheet pairs hook and pile fastener strips 26 are re-affixed to the hook and pile fastener strip 22 on the mattress 12, securing the bed sheet 24 to the mattress 12. This process is repeated for each of the pair of hook and pile fastener strips 26 on the bed sheet 24 until there is no bunching, or visible creases in the bed sheet 24. Additionally, this process can be repeated, as needed, after use of the mattress 12 and bed sheet 24 to remove visible creases in the bed sheet 24.

The cover sheet 52 is secured to the bed sheet 30 by aligning the opposing side edges 54 and foot edge 56 of the cover sheet 52 with opposing side edges 30 and foot edge 32 of the bed sheet 24. The bed sheet is positioned on the mattress 12 with the upper side hook and pile fastener strips 62 being positioned beneath the underside of the mattress 12. The foot edge 56 of the cover sheet is position under the mattress 12 such that the cover sheet hook and pile faster strips 60 engages the hook and pile fastener strips 62 on the bed sheet 24, securing the foot edges 56 of the cove sheet 52 to the bed sheet 24.

Although the above description has been directed to a traditional mattress having substantially flat defined ends and sides, the invention is equally applicable to air, water, or futon mattresses that have rounded sides. For these mattresses, the side or the bottom of the mattress is provided with strips to engage the sheet strips. Further, although the invention has been described with respect to sheets and mattress pads, the invention also encompasses seats and couches and covers (fabric or plastic) therefor.

The invention is particularly beneficial to futons. Known futon covers completely encase a futon mattress. However, as anyone who has attempted the feat can attest, it can be extremely difficult to lift a relatively heavy and unwieldy futon mattress sufficiently to stuff it into the cover. Accordingly, futon covers are rarely changed or washed. Fitted sheets or blankets would be a much more sanitary option as they are easily removed for cleaning, but they are unsuitable as futon covers because they cannot follow the folds of the couch or chair configuration of the futon and present the snug fit of the full-enclosure cover. By contrast, a futon cover configured like a fitted sheet with fastener strips as described above in combination with a futon mattress having peripheral or longitudinal (and/or lateral) engagement strips would be very appealing.

Similarly, the fastening system of the present invention can be mated to a table and tablecloth. For example, a kit can comprise adhesive backed complimentary fasteners, wherein a number of fasteners (or an elongate strip) are stuck to the side of a table (e.g., a picnic table) and complimentary fasteners are adhered to the underside of a tablecloth. This configuration is an inexpensive and satisfying alternative to piling heavy objects around the periphery of a picnic table on a windy day.

Although the invention has been described above with respect to the use of hook and pile fasteners, other embodiments of the invention substitute fasteners such as snaps or buttons/eyelets for the hook and pile arrangement. Hook and pile fastening however, is believed to be especially useful as it provides virtually unlimited positioning/engagement options. Also, whereas the invention has been described as having a fastener element that completely encircles the periphery of a mattress to ensure that complementary sheet and/or mattress pad fasteners will always, easily confront a complementary fastener, it is also possible to provide multiple, discontinuous side and/or end strips.

Thus, most broadly, the invention can be considered as a system of complementary fasteners, wherein a first fastener element defines an elongate attachment zone positioned along a first axis on a first object, a second element defines a second elongate attachment zone positioned along a second axis of a second object, and wherein the first and second axes are not coincident, but preferably substantially perpendicular.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A bedding system comprising:

a mattress including a pair of opposing side panels, a foot panel, and a head panel, and having at least one mattress hook and pile fastener strip affixed to the mattress around the periphery of the pair of opposing side panels, the foot panel, and the head panel; and a bed sheet adapted to be positioned over the mattress, the bed sheet including a pair of opposing sides portions, a foot portion, and a head portion, and having at least one bed sheet hook and pile fastener strip affixed to each of the side, foot and head portions, so as to releasably engage at least one mattress hook and pile fastener strip, wherein the at least mattress hook and pile fastener defines a plurality of elongate attachment zones on the mattress, and each bed sheet hook and pile fastener strip defines a complimentary elongate attachment zone that is configured to intercept one of the plurality of elongate attachment zones at a substantially right angle.

2. A bedding system comprising:

a mattress including a pair of opposing side panels, a foot panel, and a head panel, and having at least one mattress hook and pile fastener strip affixed to the mattress around the periphery of the pair of opposing side panels, the foot panel, and the head panel;

a bed sheet adapted to be positioned over the mattress, the bed sheet including a pair of opposing sides portions, a foot portion, and a head portion, and having at least one bed sheet hook and pile fastener strip affixed to each of the side, foot and head portions, so as to releasably engage at least one mattress hook and pile fastener strip, wherein the at least one mattress hook and pile fastener strip includes a first mattress hook and pile fastener strip is affixed to the mattress a distance of about 0 inches to 4 inches from a top surface of the mattress; and a second mattress hook and pile fastener strip that is affixed to the mattress a distance of about 0.5 inches to 2 inches from the first mattress hook and pile fastener.

3. The bedding system according to claim 2, wherein the at least one mattress hook and pile fastener strip has a width of about 0.5 inches to 4 inches.

4. The bedding system according to claim 2, where the bed sheet further includes four corners each having at least one hook and pile faster strips.

5. The bedding system according to claim 2, wherein the bed sheet is selected from the group consisting of a fitted sheet and a flat sheet.

6. The bedding system according to claim 2, wherein the bed sheet hook and pile fastener strips are about 4 inches to 12 inches in length.

7. The bedding system according to claim 2, wherein the bed sheet hook and pile fastener strips are about 0.5 inches to 2 inches in width.

8. A bedding system comprising:

a mattress including a pair of opposing side panels, a foot panel, and a head panel, and having at least one mattress hook and pile fastener strip affixed to the mattress around the periphery of the pair of opposing side panels, the foot panel, and the head panel;

a bed sheet adapted to be positioned over the mattress, the bed sheet including a pair of opposing sides portions, a foot portion, and a head portion, and having at least one bed sheet hook and pile fastener strip affixed to each of the side, foot and head portions, so as to releasably engage at least one mattress hook and pile fastener strip; and a cover sheet adapted to be position over the bed sheet, the cover sheet including at least one hook and pile fastener strip affixed to at least one cover sheet edge, wherein the cover sheet hook and pile fastener strips are affixed to the bed sheet to releasably engage an upper bed sheet hook and pile fastener strip.

9. A bedding system comprising:

a mattress including a pair of opposing side panels, a foot panel, and a head panel, and having at least one mattress hook and pile fastener strip affixed to the mattress continuously along a peripheral edge of the pair of opposing side panels, the foot panel, and the head panel;

a bed sheet adapted to be positioned over the mattress, the bed sheet including a pair of opposing side edges, a foot edge, and a head edge, and having at least one pair of bed sheet hook and pile fastener strips affixed to each of the opposing side edges, the bed sheet hook and pile fastener strips being affixed to the bed sheet to releasably engage the mattress hook and pile fastener strip at a substantially right angle; and a mattress pad adapted to be interposed between the bed sheet and the mattress, the mattress pad including a plurality of hook and pile fastener strips affixed to a plurality of mattress pad edges, wherein the mattress pad hook and pile fastener strips are affixed to the mattress pad to releasably engage the mattress hook and pile fastener strip at a substantially right angle.

10. The bedding system according to claim 9, wherein the at least one mattress hook and pile fastener strip includes a first mattress hook and pile fastener strip is affixed to the mattress a distance of about 0 inches to 4 inches from a top surface of the mattress.

11. The bedding system according to claim 10, wherein a second mattress hook and pile fastener strip is affixed to the mattress a distance of about 0.5 inches to 2 inches from the first mattress hook and pile fastener.

12. The bedding system according to claim 9, where the bed sheet further includes four corners each having at least one hook and pile fastener strip.

13. The bedding system according to claim 12, wherein at least one the bed sheet hook and pile fastener strip is affixed to each of the foot edge and head edge.

* * * * *